US005509432A

United States Patent [19]

Peterson

[11] Patent Number: 5,509,432

[45] Date of Patent: Apr. 23, 1996

[54] DEVICE FOR ASSISTING A DISABLED PERSONS TO SIT OR STAND

[75] Inventor: Jon V. Peterson, 159 Bellman St., Throop, Pa. 18512

[73] Assignees: Jon V. Peterson; Pat R. Peterson, Throop, Pa.

[21] Appl. No.: 500,184

[22] Filed: Jul. 10, 1995

[51] Int. Cl.[6] ..... A45B 1/00

[52] U.S. Cl. ..... 135/65; 135/66

[58] Field of Search ..... 135/65, 66, 67, 135/72, 75, 76

[56] References Cited

U.S. PATENT DOCUMENTS

| | | | |
|---|---|---|---|
| 2,757,388 | 8/1956 | Chisholm | 135/65 X |
| 3,739,793 | 6/1973 | Wilson | 135/45 |
| 4,844,107 | 7/1989 | Watkins | 135/65 |
| 4,894,871 | 1/1990 | Schmerler | 135/67 X |
| 4,948,156 | 8/1990 | Fortner | 280/304 |
| 4,964,182 | 10/1990 | Schmerler | 135/67 X |
| 4,987,622 | 1/1991 | Shockey | 5/81 R |
| 5,007,618 | 4/1991 | Libby | 135/65 X |
| 5,226,439 | 7/1993 | O'Keeffe et al. | 135/66 |
| 5,295,498 | 3/1994 | van Meter et al. | 135/65 |
| 5,305,773 | 4/1994 | Browning | 135/65 X |
| 5,449,013 | 9/1995 | Landers | 135/67 |

*Primary Examiner*—Lanna Mai

*Attorney, Agent, or Firm*—Joseph W. Molasky & Associates

[57] ABSTRACT

A device for assisting a disabled person to rise from a sitting to a standing position and for assisting a disabled person to sit from a standing position. The device includes a base mat to which are attached side support plates on which are mounted a plurality of horizontal floor rods and slotted vertical bars in which cross-handrails are inserted and adjustably mounted by means of tubes extended from the cross-handrails. In a preferred embodiment, the component parts of the device may be assembled and disassembled as needed. The device is arranged to be compatible for use with both wheelchairs and walkers.

10 Claims, 5 Drawing Sheets

DEVICE FOR ASSISTING A DISABLED PERSONS TO SIT OR STAND

BACKGROUND OF THE INVENTION

This invention relates to a device for assisting a disabled person to rise from a sitting position to a standing position and for assisting a person to lower from a standing position to a sitting position.

Many people suffer from medical conditions such as arthritis, muscular injury, muscular disease, back injuries, knee injuries, obesity, or simply advanced age which makes moving from a sitting to a standing or a standing to a sitting position difficult.

It is very trying for people who suffer from such conditions to sit down and rise from chairs, beds, sofas, and wheelchairs. As a result, disabled people often remain seated when, in fact, rising from a chair or a bed and walking would provide exercise to the disabled person.

There are a number of devices which have been utilized to assist disabled persons to sit and to rise. However, these devices have generally been so large in size as to be cumbersome, or have not been of sturdy construction to prevent a disabled person from falling when using the device. Additionally, some devices are not compatible for use with other disability aids such as wheelchairs and walkers.

Thus, a need exists for a device which allows a disabled person to rise from a seat to a standing position and to sit from a standing position without the device tipping over and yet is both portable and not cumbersome to move from one location to another.

A need also exists for a device which allows a person to sit in and rise from chairs, sofas, and beds, and is compatible with both wheelchairs and walkers.

OBJECTS OF THE INVENTION

It is an object of this invention to provide a device which assists a disabled person to rise from a seat and to sit from a standing position and that is stable and not prone to tipping over. It is also an object of this invention to provide a device which is portable and not cumbersome to move from one location to another. It is also an object of this invention to provide a device which allows a person to rise from a seat into a walker and to sit in a seat from a walker. It is also an object of this invention to provide a device which assists a person to rise from a wheelchair to a standing position and to sit into a wheelchair from a standing position.

SUMMARY OF THE INVENTION

The device of the present invention, which is broadly described herein, comprises a base mat having a non-skid surface; side support plates mounted respectively on the left and right edges of the base mat; a plurality of horizontal floor rods attached to the side support plates; a plurality of slotted vertical tubes secured to the side support plates; and cross-handrails having tubes extended. therefrom and arranged to be received into the slotted vertical tubes and to be adjusted to set the hand cross-rails at a height suitable for the person using the device. The tubes extended from the cross-handrails are adjusted in heighth by set-screws extending through the slots of the slotted vertical tubes. The present device is such that it is able to be disassembled, e.g., the side support plates may be removed from the base mat and the floor rods from the support plates.

DESCRIPTION OF THE PREFERRED EMBODIMENT

Figure 1:
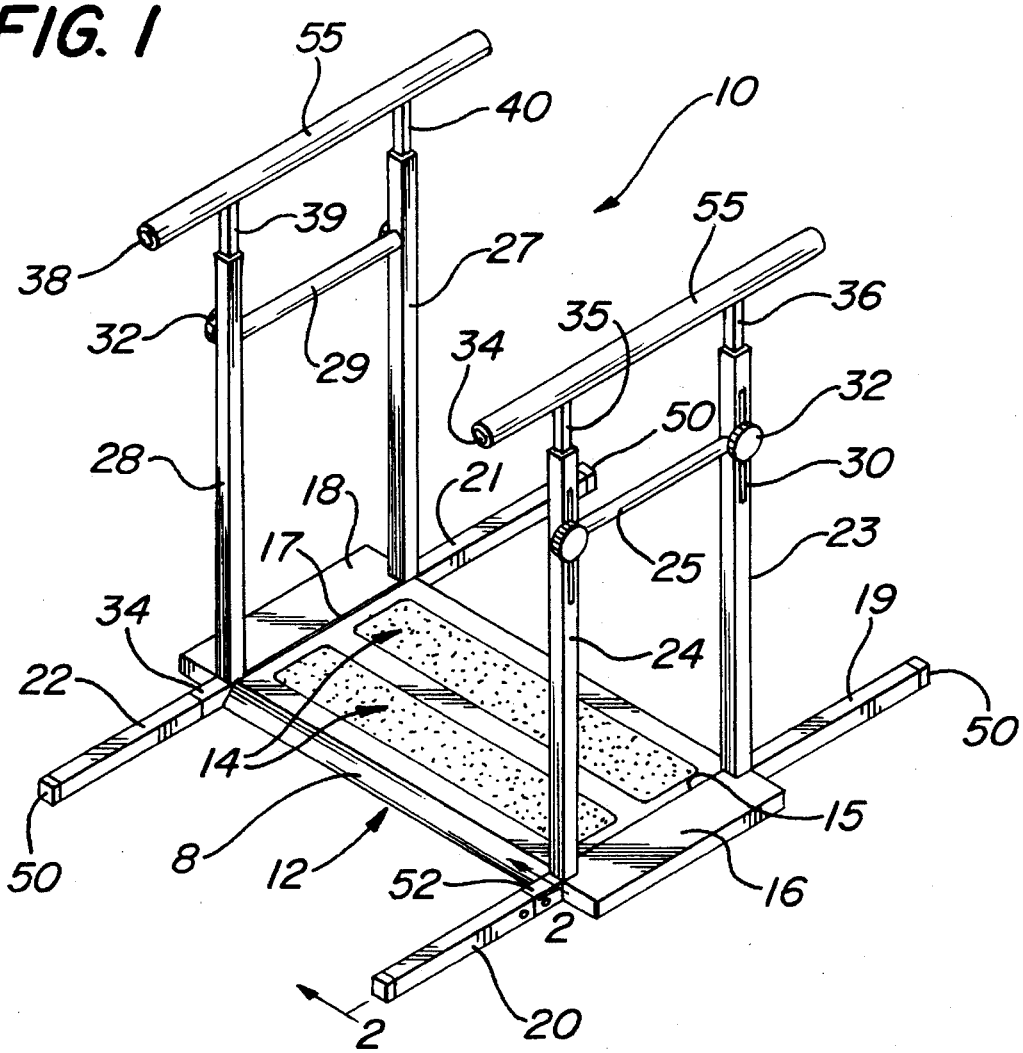
FIG. 1 is a perspective view of the device according to the present invention.

The present device of this invention is indicated generally as 10 in FIG. 1. Device 10 is comprised of a base mat 12 having a non-skid surface 14; side support plates 16 and 18 secured, respectively, to the right 15 and left 17 edges of base mat 12 and onto which are mounted, a plurality of horizontal floor rods 19, 20, 21, and 22, and slotted vertical bars 23, 24, 27, and 28 into which respective tube pairs are slidably received, i.e., tubes 35 and 36, extended from cross-handrail 34 into slotted bars 24 and 23 and tubes 39 and 40 extended from cross-handrail 38 into slotted bars 28 and 27.

The base mat 12 has a non-skid surface 14, a right edge 15 onto which support plate 16 is attached and a left edge 17 onto which support plate 18 is attached.

On the front edges of support plates 16 and 18, respectively, horizontal floor rods 19 and 21 are mounted while on the rear edges of support plates 16 and 18, respectively, horizontal floor bars 20 and 22 are secured to extensions 52 and 54, respectively, of side support plates 16 and 18.

Slotted vertical bar pairs 23, 24 and 27, 28 are respectively mounted on support plates 16 and 18. As indicated above, slotted vertical bars 23 and 24 are arranged to, respectively, receive tubes 36 and 35 attached to and extended from cross-handrail 34 while slotted vertical bars 27 and 28 are arranged to receive, respectively, tubes 40 and 39 attached to and extended from cross-handrail 38.

FIG. 1 illustrates that device 10 is specifically arranged for the safety of a disabled person, i.e., user. For example, the base mat 12 is beveled on its rear edge 8 to allow the user to easily step onto mat 12 without tripping. And, the side support plates 16 and 18 beside having floor rods 19–22 and vertical bars 23, 25, 27, and 28 mounted thereon are provided to prevent the device 10 from tipping to one side or the other when the weight of the disabled person., i.e., user, is shifted. Moreover, the extended lengths of floor rods 19, 20 and 21, 22 are greater than that of the respective cross-handrails 34 and 38 to prevent the device 10 from tipping forward or backward.

Figure 3:
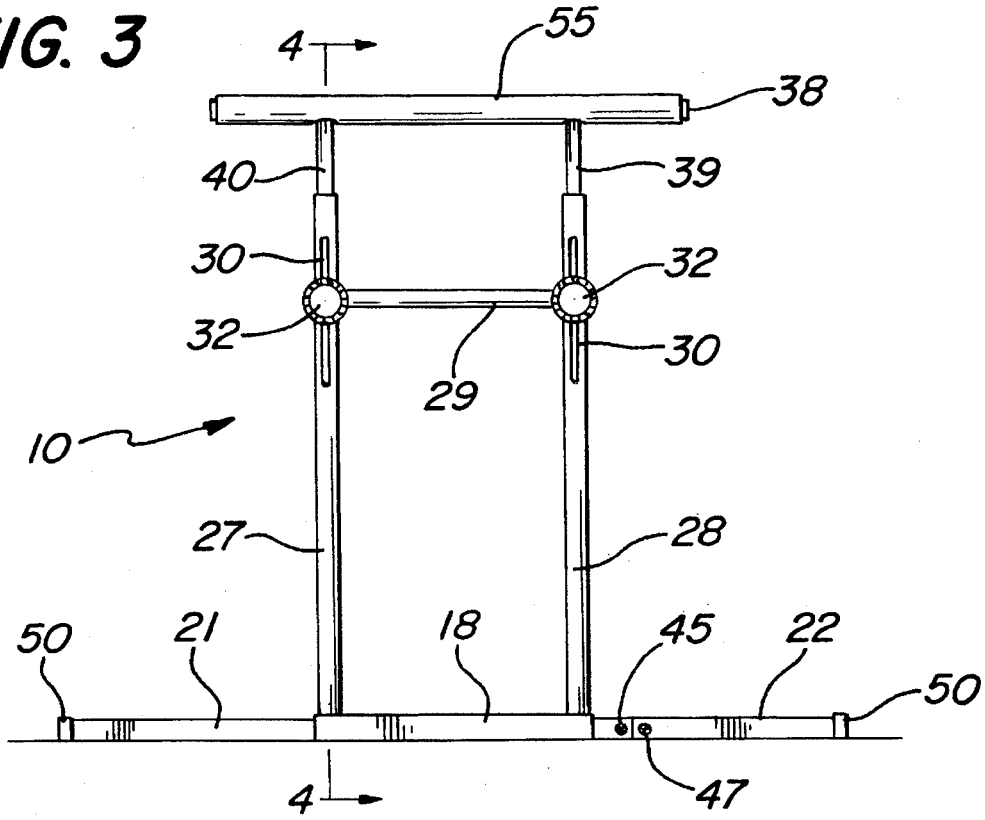
FIG. 3 is a side view of the device as shown in FIG. 1.

As shown in FIG. 1, the vertical slotted tube pairs 23, 24 and 27, 28 are further stabilized, respectively, by brace 25 and brace 29. Also, as illustrated in FIGS. 1 and 3, each of slotted vertical bars 23, 24, 27, and 28 have partial slots 30 with set-screws 32 to adjust the height of the cross-handrails 34 and 38. For example, this is accomplished by set-screws 32 being extended through, respectively, the tubes 35 and 36 secured to handrail 34 and extended therefrom and slidably inserted, respectively, into slotted bars 24 and 23. Similarly, the same arrangement is provided for slotted vertical bars 28 and 27 having tubes 39 and 40 inserted therein, respectively. Such tubes 39, 40 are secured to and extended from cross-handrail 38.

Figure 4:
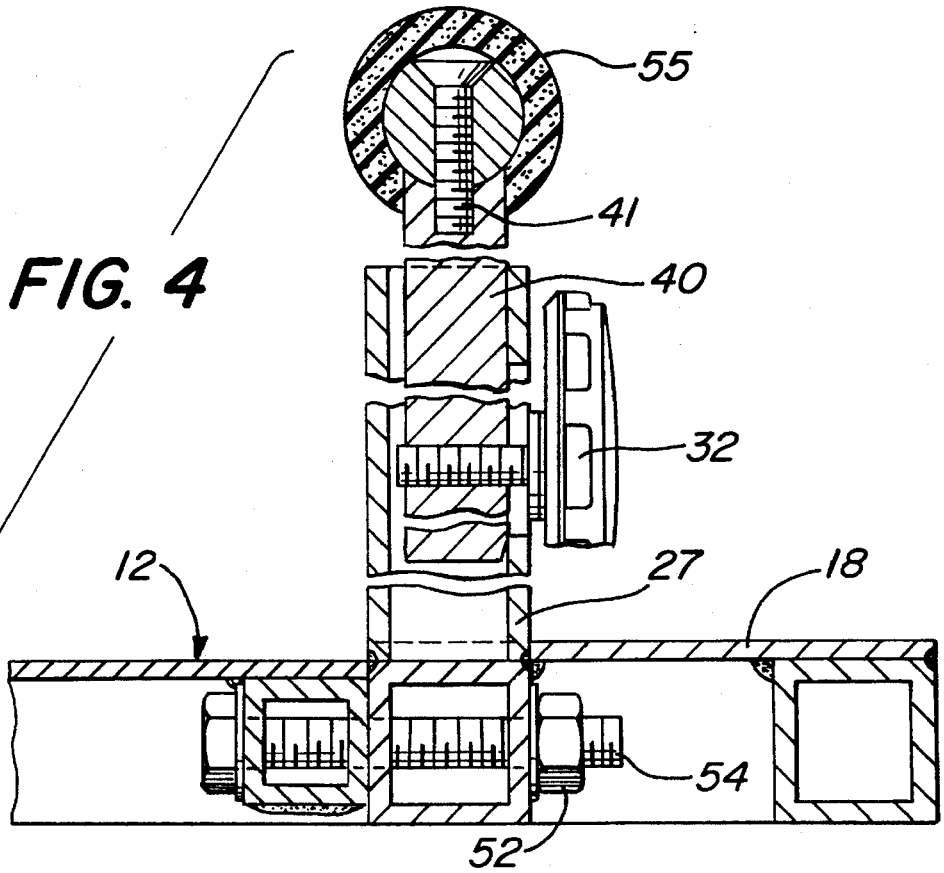
FIG. 4 is a view of the device taken along line 4—4 of FIG. 3.

In FIG. 4, which includes a partial sectional view of slotted bar 27 mounted on side support plate 18, there is shown the arrangement of handrail 38 having tube 40 secured thereto by bolt 41 and extended therefrom into slotted vertical bar 27 which is mounted on side support plate 18 attached to base mat 12 by a nut 52 and bolt 54 arrangement. A set-screw 32 extends through the slot 30, of slotted vertical bar 27 into an opening of inserted tube 40 to adjust the height of cross-handrail 38 which is encased in a foam rubber sleeve 55 to provide a good secure grip for the user of the device 10. A similar sleeve 55 of foam rubber is provided for cross-handrail 34.

As shown in FIGS. 1 and 3, each of the horizontal floor rods, i.e., the front floor rods 19, 21 and rear floor rods 20, 22 extending, respectively, from extensions 52 and 54 of side support plates 16 and 18, respectively, have a polymeric end cap 50.

Figure 2:
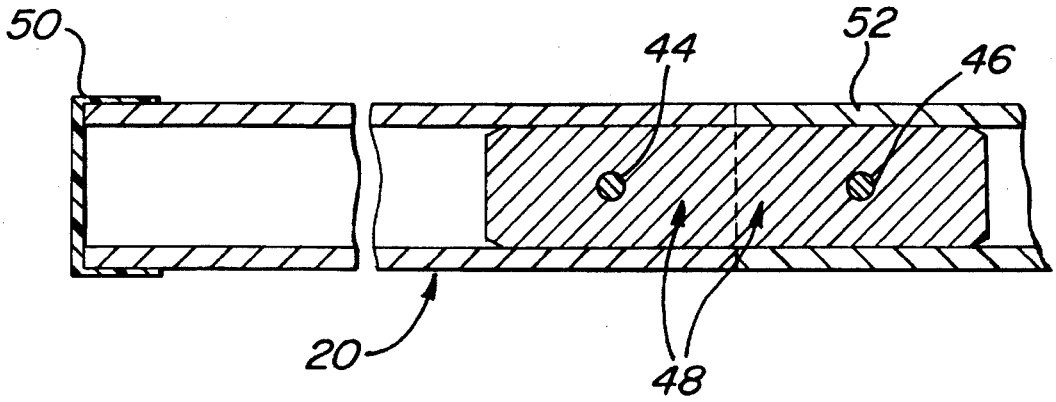
FIG. 2 is a view of a horizontal floor rod of the device taken along line 2—2 of FIG. 1.

Also, as specifically shown in FIG. 2 and indicated in FIG. 3, the rear horizontal floor rods 20, 22 each have connecting studs 48 mounted therein which fit into extended portions of side support plates 16 and 18, respectively, 52 and 54 and are secured therein, respectively, by screws 44, 46 and 45, 47 or the like. The front horizontal floor rods 19 and 21 may also be arranged in this manner to provide a device which may be disassembled for shipping or to be used in another location.

Figure 5:
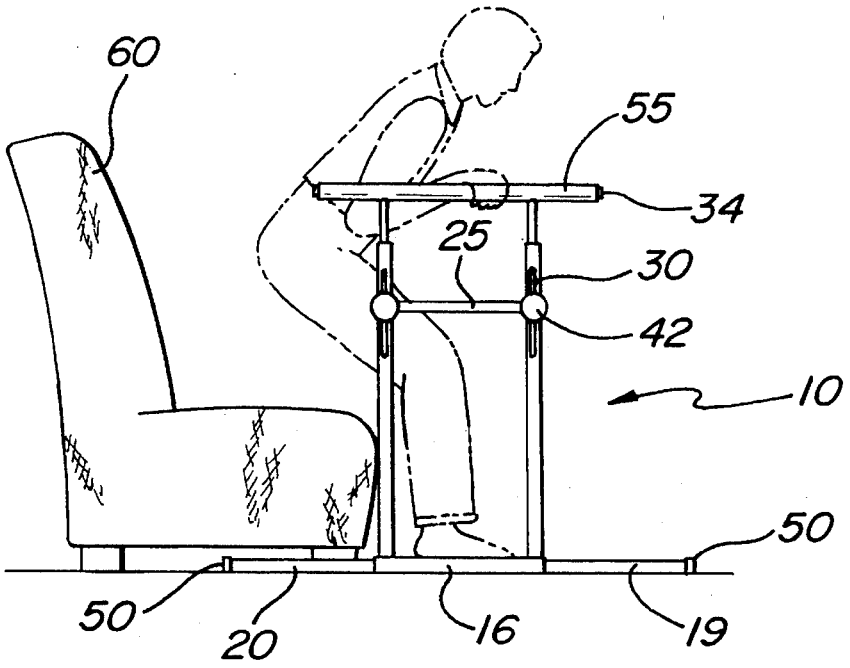
FIG. 5 is a side view illustrating a person utilizing the device with a chair.
Figure 6:
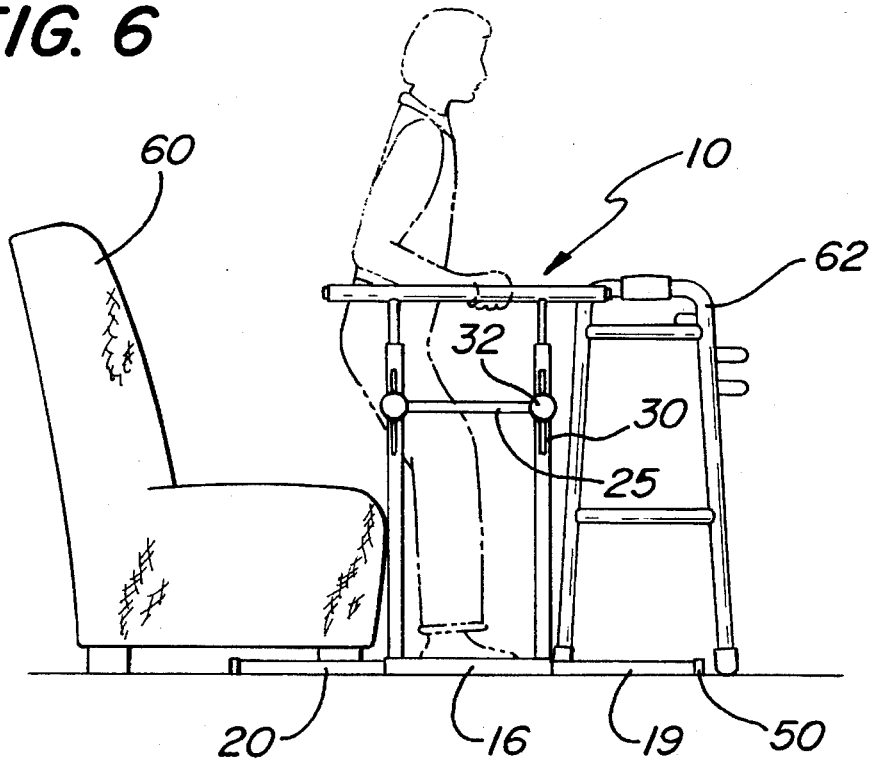
FIG. 6 is a side view illustrating a person utilizing the device with a walker and a chair.

This invention may be utilized as illustrated in FIGS. 5 through 10. As shown, in order to utilize the device to rise from a chair, a person grasps the foam rubber sleeves 55 on cross-handrails 34 and 38 with both hands while placing both feet on base mat 12. A person then pulls their posterior from the seat, using their hands as shown in FIG. 5 while shifting their posterior from above the seat to above their feet thus achieving a standing position as shown in FIG. 6.

To sit, a person grasps both foam rubber sleeves, respectively, on cross-handrails 34 and 38 while standing on the base mat 12 as shown in FIG. 6. The person then crouches slightly by resting both hands on the foam rubber sleeves 55 and shifts their posterior from over their feet to over the seat as shown in FIG. 5. A person then utilizes their arms to lower their posterior into the seat thus achieving a sitting position.

Figure 7:
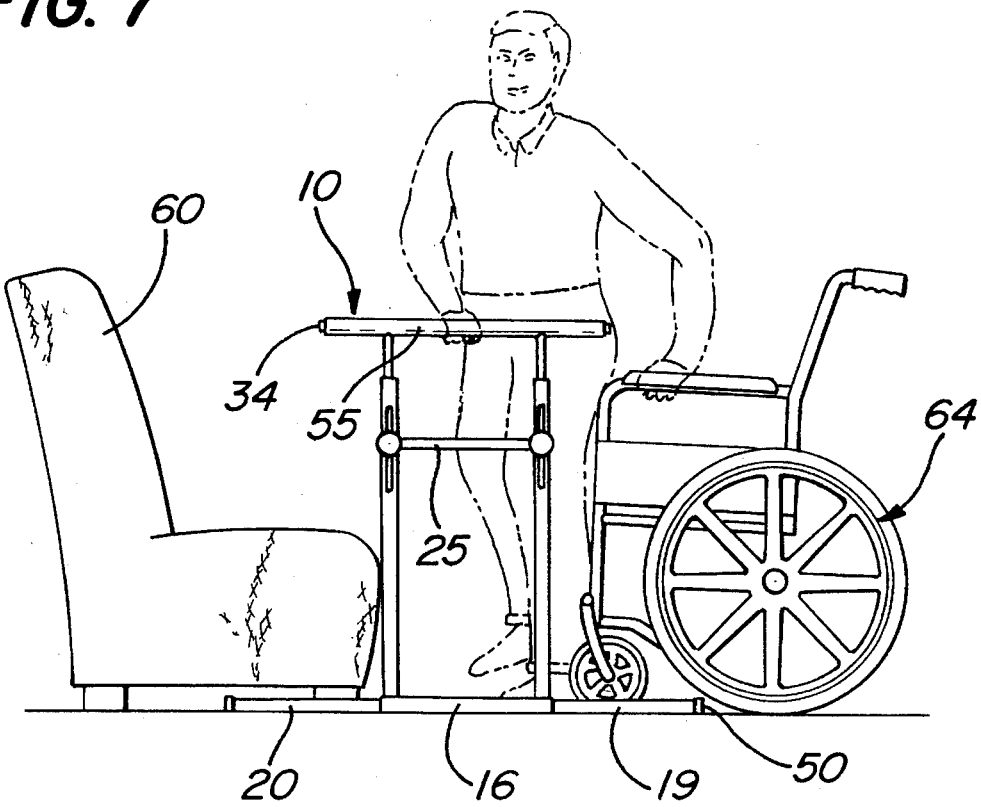
FIG. 7 is a side view illustrating a person utilizing the device with a wheelchair and a chair.
Figure 8:
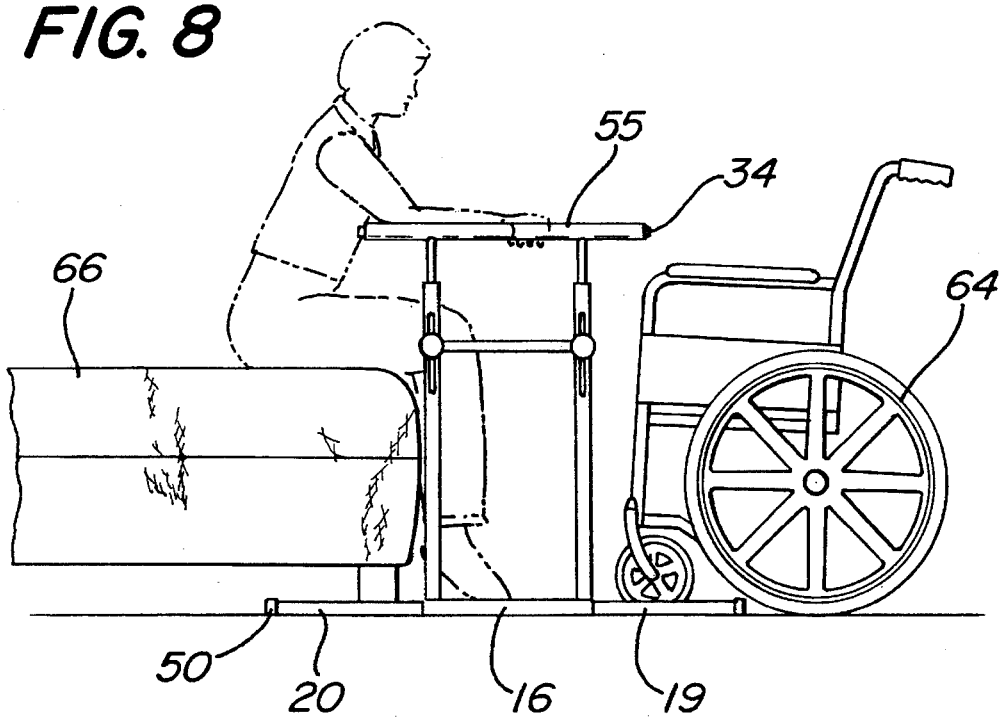
FIG. 8 is a side view illustrating a person utilizing the device with a wheelchair and a bed.
Figure 9:
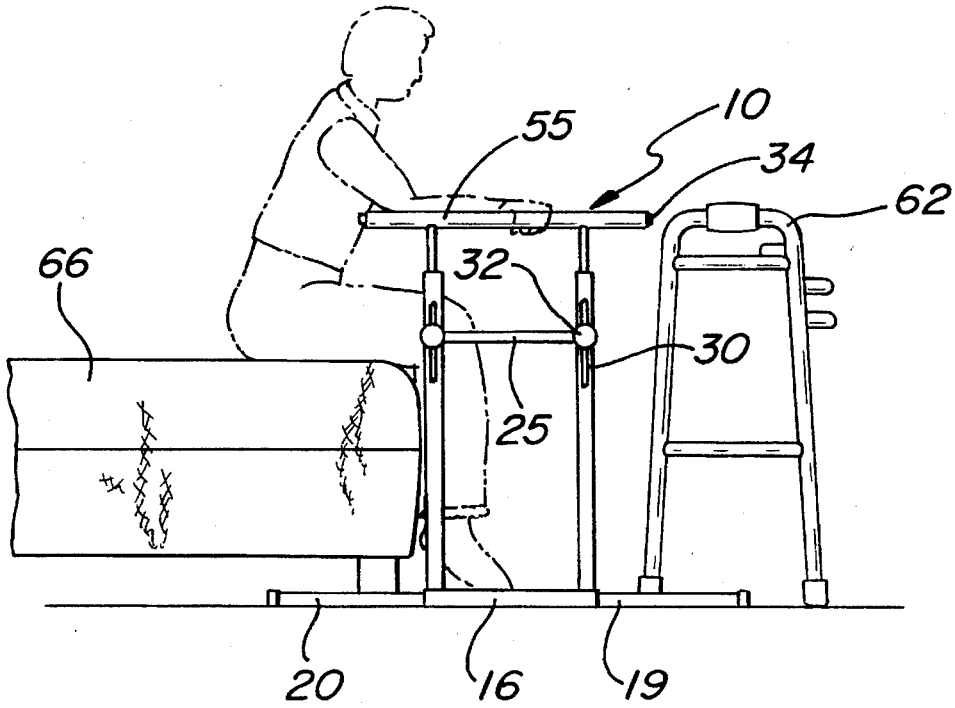
FIG. 9 is a side view illustrating a person utilizing the device with a walker and a bed.
Figure 10:
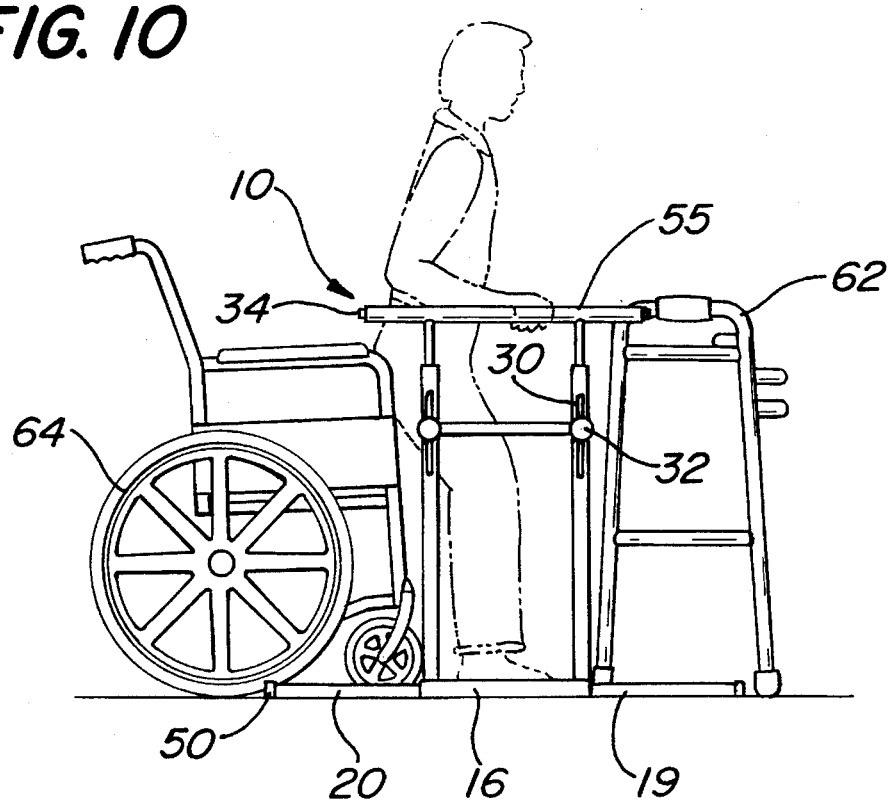
FIG. 10 is a side view illustrating a person utilizing the device with a walker and a wheelchair.

The device 10 has several important features which enhance the devices usefulness. Although device 10 is small enough to be portable and yet is large enough to be stable during use. The distance between the horizontal floor bars is sufficient to accommodate both the front wheels of a wheelchair 60 as shown in FIGS. 7, 8, and 10 and the front legs of a walker 62 as shown in FIGS. 6, 9, and 10. That is, the front wheels of the wheelchair 60 as well as both front legs of the walker 62 fit securely and safely in between the horizontal floor rods. These features allow the user the freedom and flexibility to rise from or sit down on a variety of chairs and beds and conveniently utilize both wheelchairs and walkers in cooperation with the device 10.

The horizontal floor rods which extend in front and in back of the device, i.e., base mat 12, allow the user to lean forward and backward without fear of falling so long as the user grasps the foam rubber coated handrails 34 and 38 and keeps both feet on the base mat 12. The base mat 12 is located between the handrails 34 and 38 and the horizontal floor rods 19, 20, 21, and 22 in a position which ensures that when a person stands on mat 12, the person's bodyweight anchors the device in one solid position during use of the device to prevent the device from tipping over and causing the user to fall. Thus, the user is confident in using the device that they will not fall thus increasing the possibility that a disabled person in need of exercise will use the device.

Moreover, the device is preferably constructed of a solid durable material such as steel, i.e., plate or cast, or aluminum, to provide the strength needed to allow a person to pull themselves into a standing position from a seat and to lower themselves into a seat from a standing position without the device failing structurally.

Thus, accordingly, this invention provides a device 10 which assists a disabled person to both rise from a seat and to sit from a standing position. The device being durably constructed is not prone to tipping over. The device is also compact and portable to facilitate the movement of the device from one seat to the next and can be utilized in conjunction with both wheelchairs and walkers.

While the preferred embodiments have been fully described and depicted for the purposes of explaining the principles of the present invention, it will be appreciated by those skilled in the art that modification and changes may be made thereto without departing from the scope of the invention set forth in the appended claims.

What is claimed is:

1. A device for assisting a disabled person to rise from a sitting position to a standing position and for assisting a disabled person to lower from a standing to a sitting position, said device comprising:

a base mat having a non-skid surface;

side support plates attached to said base mat;

a plurality of horizontal floor rods mounted on and extended from said side support plates;

a plurality of slotted vertical bars mounted on said side support plates;

cross-handrails slidably and adjustably mounted by tubes extending therefrom and inserted within said slotted vertical bars; and brace support bars connected to said vertical slotted bars.

2. The device of claim 1, wherein said base mat has left and right edges to which said side support plates are, respectively, attached.

3. The device of claim 1, wherein said base mat has a skid-resistant top surface.

4. The device of claim 1, wherein said side support plates have front and rear edges on which said horizontal floor rods are mounted and extended therefrom.

5. The device of claim 1, wherein said device is arranged to be disassembled and assembled.

6. The device of claim 1, wherein the height of said cross-handrails may be set according to said disabled person by set-screws arranged in the slots of said slotted vertical bars.

7. The device of claim 1, wherein the device is arranged to safely accommodate the front wheels of a wheelchair and the front legs of a walker in between said horizontal floor rods.

8. The device of claim 1, wherein the rear edge of said base mat is beveled to allow said disabled person to step onto said base mat without tripping.

9. The device of claim 1, wherein said side support plates prevent the device from tipping to one side or the other by the weight shifting of said disabled person.

10. The device of claim 1, wherein the extended lengths of said floor rods are greater than that of said respective cross-handrails to prevent the device from tipping forward or backward.

* * * * *